US005491899A

United States Patent [19]

Schliemann et al.

[11] Patent Number: 5,491,899

[45] Date of Patent: Feb. 20, 1996

[54] TENSIONING ARRANGEMENT FOR A SAW CHAIN

[75] Inventors: Harald Schliemann, Waiblingen; Rudolf Krebs, Backnang; Werner Geyer, Waiblingen; Hans Nickel, Cottenweiler; Helmut Zimmermann, Kernen, all of Germany

[73] Assignee: Stihl Andreas, Waiblingen, Germany

[21] Appl. No.: 296,153

[22] Filed: Aug. 29, 1994

Related U.S. Application Data

[63] Continuation-in-part of Ser. No. 70,755, Jun. 3, 1993, abandoned.

[30] Foreign Application Priority Data

Jun. 25, 1992 [DE] Germany ..... 42 20 845.9

[51] Int. Cl.[6] ..... B27B 17/14

[52] U.S. Cl. ..... 30/386; 83/816

[58] Field of Search ..... 30/386, 385; 83/717, 83/816

[56] References Cited

U.S. PATENT DOCUMENTS

| | | | |
|---|---|---|---|
| 2,624,379 | 1/1953 | Arneson | 30/386 |
| 2,765,821 | 10/1956 | Strunk | 30/386 |
| 3,636,995 | 1/1972 | Newman | 30/386 |
| 4,129,943 | 12/1978 | Bricker | 83/816 |
| 5,001,958 | 3/1991 | Hall | 30/386 X |
| 5,174,029 | 12/1992 | Talberg | 30/386 |

FOREIGN PATENT DOCUMENTS

| | | | |
|---|---|---|---|
| 1106264 | 8/1981 | Canada . | |
| 651279 | 9/1937 | Germany | 83/717 |
| 1144882 | 3/1985 | U.S.S.R. | 30/386 |

*Primary Examiner*—Kenneth E. Peterson
*Attorney, Agent, or Firm*—Walter Ottesen

[57] ABSTRACT

The invention is directed to a tensioning arrangement for a saw chain of a motor-driven chain saw. The saw chain runs on a guide bar mounted on the motor housing of the chain saw. The tensioning arrangement includes a rotatable disc having a spirally-shaped guide slot in which a lug of a slide piece engages. The longitudinal displacement of the guide bar is provided by rotating the disc. The guide slot in the disc extends over a rotational angle of at least 270°. A still lesser slope of the guide slot is provided with a rotational angle in the range of 360° to 450°. The tensioning arrangement is especially suitable for adjusting the guide bar in motor-driven chain saws thereby adjusting the tension in the saw chain.

21 Claims, 3 Drawing Sheets

TENSIONING ARRANGEMENT FOR A SAW CHAIN

RELATED APPLICATION

This is a continuation-in-part of application Ser. No. 08/070,755, filed on Jun. 3, 1993, now abandoned and entitled "Tensioning Arrangement for a Saw Chain".

BACKGROUND OF THE INVENTION

Canadian Patent 1,106,264 discloses a motor-driven chain saw having a tensioning arrangement which includes essentially a slide piece and a rotatable disc. The slide piece is in engagement with the guide bar and has a lug which projects into an arcuate guide slot in the disc so that a longitudinal displacement of the slide piece, and therefore of the guide bar, takes place with a rotation of the disc. A screwdriver or similar tool is necessary for rotating the disc. With the screwdriver, slits in the disc are engaged and the disc is incrementally rotated. The adjusting procedure for the desired chain tension is most difficult because a cover plate having a window exposes only a small angular segment of the arrangement of the slits. The adjusting elements are secured by tightening a cover plate against the disc, the guide bar and the housing, with the aid of two nuts which threadably engage bolts fixed to the housing. For this purpose, a tool, namely a wrench, is required.

SUMMARY OF THE INVENTION

It is an object of the invention to provide a tensioning arrangement with which it is possible to adjust a guide bar and to reliably clamp the adjusting elements without the use of any tool.

The arrangement of the invention is for manually tensioning the saw chain of a motor-driven chain saw without tools, the chain saw having a motor housing and a guide bar for guiding the saw chain, the guide bar being subjected to thrust forces during operation of the chain saw and defining a longitudinal axis; the guide bar having two flat sides, one of the flat sides facing toward the housing and the other one of the flat sides facing away from the housing. The arrangement includes: the guide bar having an elongated opening formed therein so as to extend in the direction of the axis; a stud bolt fixedly attached to the housing and extending transversely to the guide bar and through the elongated opening; a manually actuated clamping member mounted on the stud bolt which can be tightened by an operator of the chain saw by manually grasping the clamping member with the hand to provide a clamping force to clamp the guide bar on the housing to resist the thrust forces and which can be released to permit the guide bar to be moved along the axis; a flat slide piece having a flat body and having engaging means formed on the flat body for engaging the guide bar and having a lug projecting from the flat body in a direction transverse to the longitudinal axis; a manually actuated rotatable disc rotatably mounted on the stud bolt with only sufficient play to allow the disc to be manually rotated by the operator by grasping the disc with the hand; the rotatable disc having an approximately spiral guide slot formed therein for receiving the lug so that a rotational movement of the rotatable disc is translated via the slide piece into a linear movement of the guide bar thereby adjusting the tension in the saw chain; the spiral guide slot defining a bearing cam surface for coacting with the lug to produce a frictional force which acts to resist rotation of the disc on the stud bolt; the spiral slot being formed in the disc so as to extend spirally over a rotational angle of at least 270°; the engaging means, the flat body, the lug, the bearing cam surface, and the rotatable disc conjointly defining a reaction force path between the guide bar and the stud bolt; and, the flat body being sandwiched between said guide bar and the rotatable disc so as to be fixedly clamped in place between the guide bar and the rotatable disc when the clamping member is tightened to transmit the clamping force to the guide bar and to augment the clamping force to resist the thrust forces via the reaction force path between the guide bar and the stud bolt.

The essential advantages of the invention are seen in that an easy and precise manual adjustment by hand is possible because of the slight slope of the guide slot and the total forces, which act in the longitudinal direction on the guide bar, are taken up by the disc without forces acting on the disc in the rotational direction. This condition is obtained because the tangent to the guide slot at the point of contact of the lug is approximately an orthogonal to the longitudinal direction of the guide bar, which lies within the resulting friction cone. The occurring forces are optimally taken up in this way.

An especially advantageous embodiment of the invention is provided in that the guide slot extends over a rotational angle which lies in the range of 360° to 450°. The slope of the guide slot is held very small because of the large rotational angle. This solution is seen to be optimal for reasons of construction and with respect to the suitable manipulability. The difference between the minimum spacing and the maximum spacing of the guide slot from the point of rotation of the disc determines the maximum displacement path of the guide bar. This difference is preferably approximately 20 mm.

The disc is provided with cutouts or recesses in its outer periphery to facilitate a handling thereof and so that it is easily rotated in the released position. Forces can occur in the guide bar for many reasons and these forces act as a torque on the guide bar. A guide element is preferably formed on the housing to receive this torque. This guide element engages in a slot of the guide bar. The guide element can be configured to be elongated or round.

A purposeful configuration of the slide piece comprises that the slide piece is configured so as to be essentially a U-shaped member. The lug, which coacts with the guide slot, is disposed on the bight of the U-shaped member and, on the other side of the U-shaped member, projections are provided near the ends of the respective legs of this member which engage in corresponding openings of the guide bar.

As an alternate embodiment, the slide piece can have the form of a planar plate which has the lug for the guide slot on one side and a projection on the other side for engaging the guide bar. The lug and the projection are disposed at least approximately on the same orthogonal to the plane of the slide piece.

To make the tensioning arrangement fully manipulable without tools, a wing nut is provided which threadably engages a bolt fixed to the housing. This wing nut is dimensioned with respect to size so that a manual tightening easily develops the necessary clamping force. A knurled wheel or a wheel having an undulated periphery can be provided as a tensioning element. This element can be threadably engaged on a threaded bolt fixed on the housing. A pressure plate, secured against rotation, can be provided between the tensioning element and the disc.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
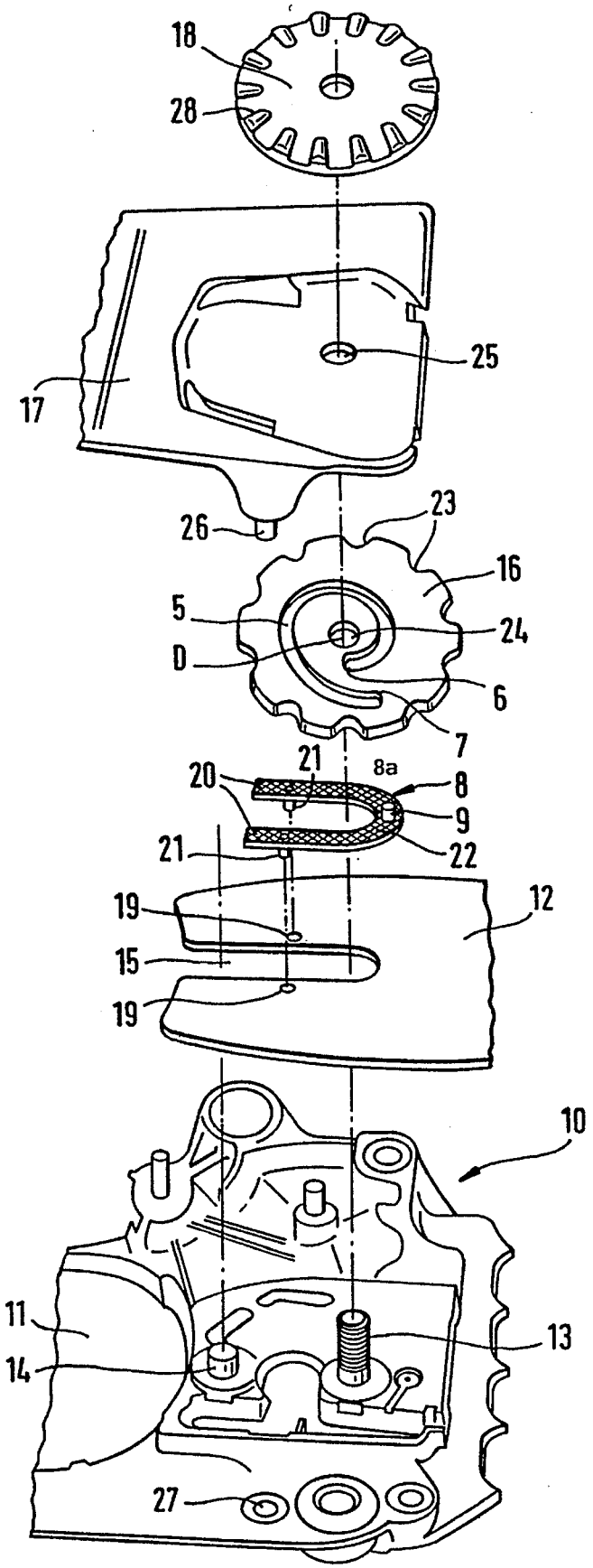
FIG. 1 is an exploded view of a first embodiment of a tensioning arrangement according to the invention.

FIG. 1 shows a portion of a housing 10 of a motor-driven chain saw. This portion is in the region which is provided with an opening 11 for the drive sprocket (not shown) and the clamping device for the guide bar 12. The clamping device includes a stud bolt 13 fixed to the housing and a guide lug 14. The stud bolt 13 has a length selected so that it extends in the region of an elongated opening 15 through the guide bar 12 as well as through a rotatable disc 16 and a pressure plate 17. A handwheel 18 threadably engages the winding on the end portion of the stud bolt 13. The guide lug 14 is so dimensioned that it engages in the elongated opening 15 of the guide bar and thereby precisely guides the guide bar 12 in the longitudinal direction as well as taking up torque forces.

Two openings in the form of small bores are provided in the guide bar 12 laterally of the elongated opening 15. Lugs 21 arranged on the ends of the legs 20 of a U-shaped slide piece 8 engage corresponding ones of the bores 19 with a precise fit. The U-shaped slide piece 8 is provided with a lug 9 on the arcuate bight portion 22 thereof. The lug 9 projects from the slide piece on the side thereof facing away from the guide bar 12. This lug 9 engages in an arcuately extending guide slot 5 in the rotatable disc 16. The guide slot 5 extends over an angle of rotation of approximately 390°. One end 6 of the guide slot 5 has a minimal spacing to the center D of rotation and the other end 7 has a maximum spacing. By manually rotating the disc 16, the rotational movement of the disc 16 is translated into a longitudinal displacement of the slide piece 8 because of the lug 9 engaging the guide slot 5. This longitudinal displacement, in turn, effects a displacement of the guide bar 12 by the same amount. The total possible displacement is determined by the difference between the minimum spacing and the maximum spacing from the point of rotation.

The rotatable disc 16 has recesses 23 arranged uniformly on the edge thereof to permit an operator to grasp and rotate the disc with the hand. Good manipulability is ensured by the recesses 23 when adjusting the tension of the saw chain. The disc 16 is provided with a central bore 24 for journalling the disc 16 on the bolt 13. The pressure plate 17 and the handwheel 18 are provided to secure the adjusted chain tension. The pressure plate 17 has a bore 25 through which the stud bolt 13 projects and a lug 26 directed toward the housing 10. The lug 26 engages in a corresponding opening 27 of the housing and thereby secures the pressure plate 17, namely the sprocket wheel cover, against rotation. The pressure plate 17 is pressed against the disc 16 by means of the handwheel 18, which can be threadably engaged with the threaded boat 13. In this way, an unwanted displacement of the disc 16 as a consequence of vibration or the like is precluded.

It is advantageous to provide a criss-cross or similar embossment on the side of the disc 16 facing toward the slide piece 8 as well as on the side of the slide piece 8 facing toward the disc 16. In this way, a frictional grip between the parts is increased. A corresponding rotation of the disc 16 is thereby prevented when rotating the handwheel 18 tight. The handwheel 18 is provided with peripheral undulations 28 so that an adequate force can be applied with the hand by the operator to the handwheel 18 without a tool.

During use of the chain saw, the guide bar 12 is subjected to thrust forces. The manually actuated clamping mender 18 provides a clamping force when tightened to clamp the guide bar 12 on the housing of the chain saw to resist these thrust forces as well as to resist lateral forces.

The rotatable disc 16 is rotatably mounted on the stud bolt 13 with only sufficient play to allow the disc 16 to be manually rotated by the operator by grasping the disc 16 with the hand. As shown in FIG. 1, the flat slide piece 8 has a flat body **8*a* and lugs 21 which engage the guide bar 12 and a lug 9 which is in contact engagement with the bearing cam surface of the guide slot 5. The lugs 21, the flat body 8*a*, the lug 9, the bearing cam surface of the guide slot 5 and the rotatable disc 16 conjointly define a reaction force path between the guide bar 12 and the stud boat 13**.

The flat body **8*a* is sandwiched between the guide bar and the rotatable disc 16 so as to be fixedly clamped in place between the guide bar and the rotatable disc when the clamping member 18** is tightened to transmit the clamping force to the guide bar and to augment the clamping force to resist the thrust forces via the reaction force path between the guide bar and the stud bolt.

In this way, the slide piece 8 performs multiple functions. On the one hand, the slide piece 8 facilitates the translational movement imparted thereto by the rotatable disc 16 while, on the other hand, it transmits the clamping force to the guide bar and assists in resisting the thrust forces imparted to the guide bar during use of the chain saw because of the above-mentioned reaction force path between the guide bar 12 and the stud bolt 13.

Figure 3:
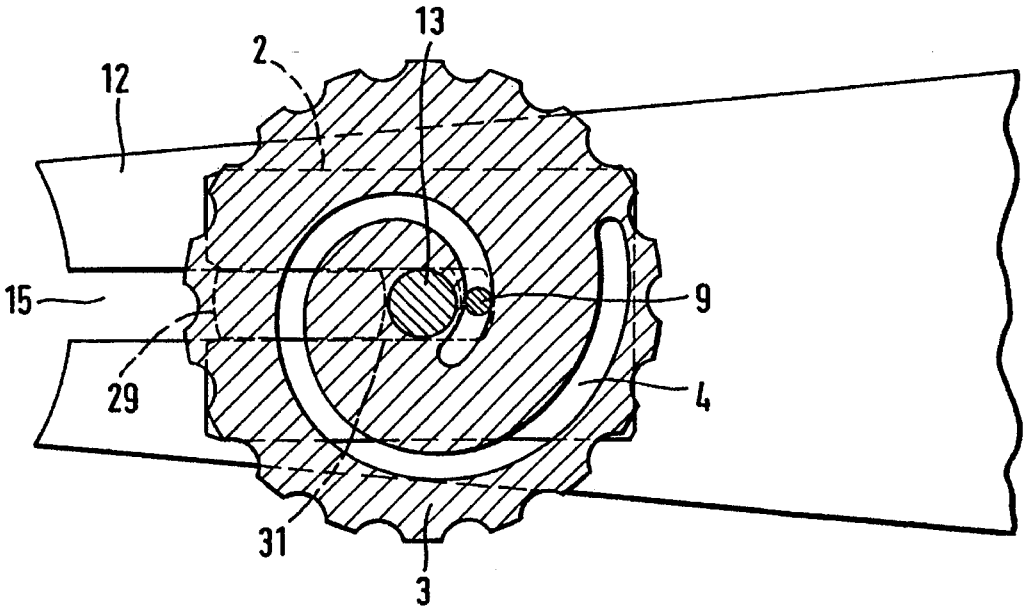
FIG. 3 is a section view along line III—III of FIG. 2.
Figure 2:
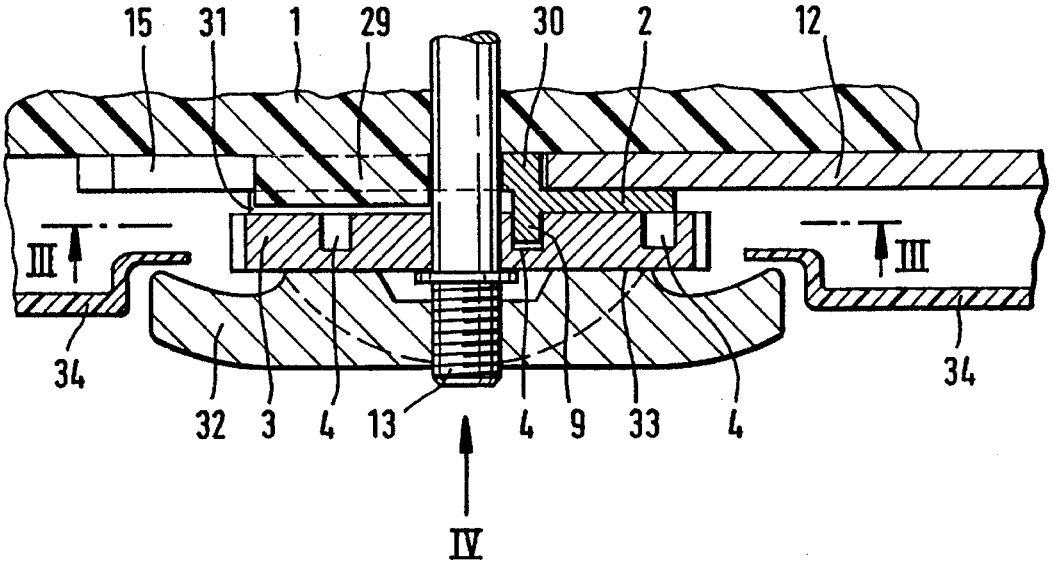
FIG. 2 is a horizontal section view taken through a tensioning arrangement according to a second embodiment of the invention.
Figure 4:
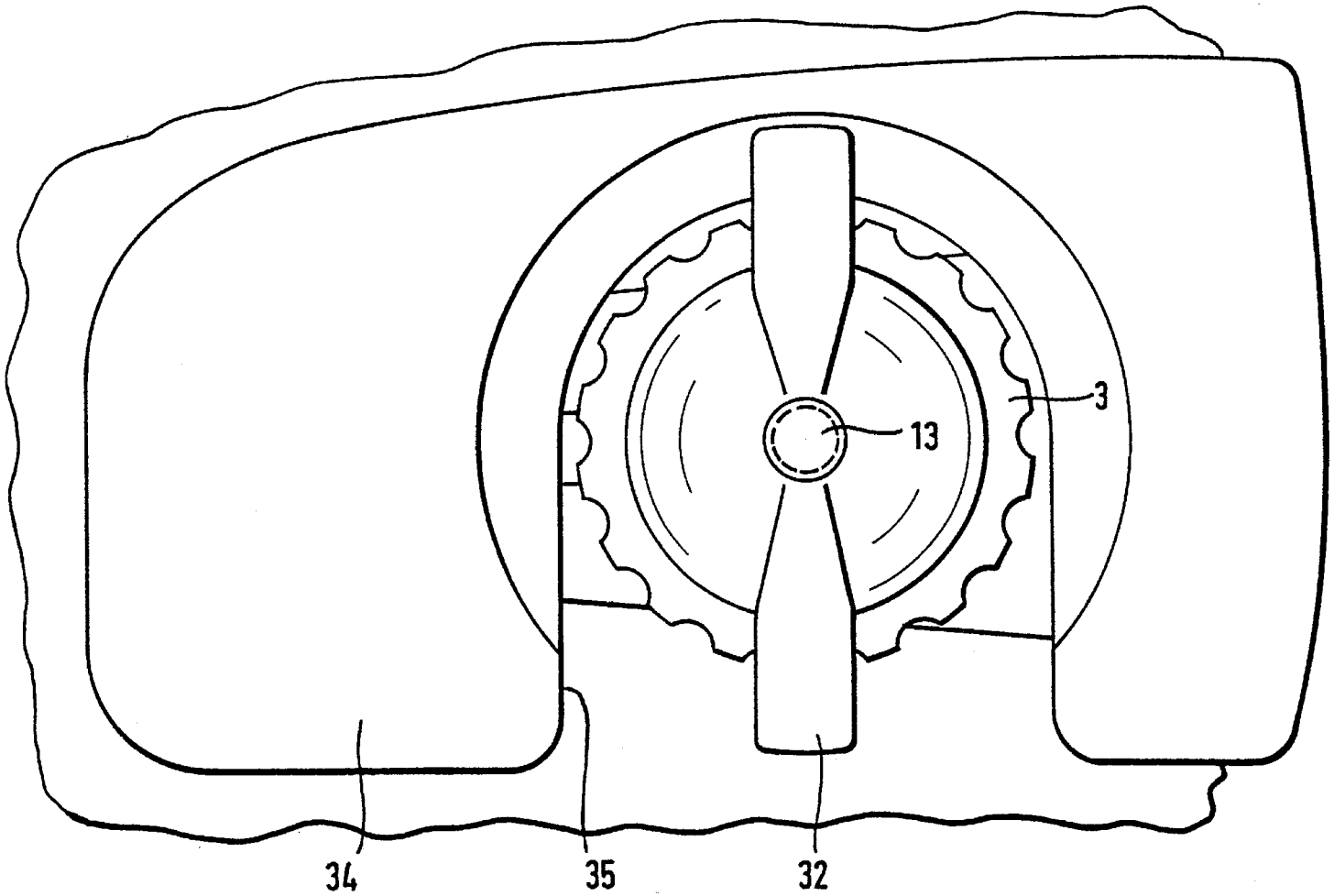
FIG. 4 is a view of the tensioning arrangement according to the second embodiment as seen in the direction of arrow IV in FIG. 2.

The tensioning arrangement shown in FIGS. 2 to 4 is based on the same principle as that shown in FIG. 1, however here, a differently configured slide piece is utilized. With this slide piece, the pressing force between the disc and the guide bar as well as between the housing and the guide bar is increased.

In FIG. 2, a section of the housing 1 is shown which can, for example, be made of plastic. The stud bolt 13 is fixed in the housing 1 and projects through the following: the elongated opening 15 of the guide bar 12, a slide piece 2 and a rotatable disc 3. An elongated guide element 29 is formed on the housing 1 and engages in the elongated opening 15 of the guide bar 12. The slide piece 2 has the form of a planar plate and a lug 9 is formed on the side of the plate facing toward the disc 3. The lug 9 projects into the guide slot 4 of the disc 3. A projection 30 is provided on the other side of the guide piece 2 and engages the elongated opening 15 of the guide bar 12 and lies in the same orthogonal to the plane of the guide piece 2 as does the lug 9.

The form of the slide piece 2 is shown in FIG. 3. The slide piece is an approximately rectangular plate having an elongated slot 31 which is aligned precisely as the elongated opening 15 of the guide bar 12. The lug 9 projects into the guide slot 4 which extends spirally about a central bore through which the stud bolt 13 projects. The total rotational angle of the guide slot 4 amounts approximately to 450° in the embodiment shown in FIG. 3. The same function, but a somewhat different slope, would be obtained if the rotational angle would amount to only 360°. By rotating the disc 3 in the clockwise direction, the lug 9 with the slide piece 2 is moved toward the right by the course of the guide slot 4 and, in this way, the lug 30 of the slide piece 2 likewise displaces the guide bar 12 to the right and thereby tensions the saw chain (not shown).

A wing nut 32 threadably engages the stud bolt 13 and is provided to reliably secure the disc 3 in the adjusted position. The wing nut 32 has a pressure surface 33 for providing a large-surface contact engagement with the disc 3. A plastic hood 34 extends approximately in the plane of the wing nut and covers the upper portion of the guide bar and the saw chain running thereon. As FIG. 4 shows, an opening 35 is provided in the plastic hood 34 so that the wing nut 32 is accessible without the necessity of first removing the plastic hood.

It is understood that the foregoing description is that of the preferred embodiments of the invention and that various changes and modifications may be made thereto without departing from the spirit and scope of the invention as defined in the appended claims.

What is claimed is:

1. An arrangement for tensioning the saw chain of a motor-driven chain saw having a motor housing and a guide bar for guiding the saw chain, the guide bar defining a longitudinal axis and having two flat sides, one of the flat sides facing toward the housing and the other one of the flat sides facing away from the housing, the arrangement comprising:

said guide bar having an elongated opening formed therein so as to extend in the direction of said axis;

a stud bolt fixedly attached to said housing and extending transversely to said guide bar and through said elongated opening;

a clamping member mounted on said stud bolt which can be tightened to clamp the guide bar on said housing and which can be released to permit the guide bar to be moved along said axis;

a flat slide piece having engaging means for engaging said guide bar and having a lug projecting from said slide piece in a direction transverse to said longitudinal axis;

a rotatable disc rotatably mounted on said stud bolt and having an approximately spiral guide slot formed therein for receiving said lug so that a rotational movement of said rotatable disc is translated via said slide piece into a linear movement of said guide bar thereby adjusting the tension in said saw chain;

said spiral guide slot defining a bearing cam surface for coacting with said lug to produce a frictional force which acts to resist rotation of said disc on said stud bolt;

said spiral slot being formed in said disc so as to extend spirally over a rotational angle of at least 270°; and, said flat slide piece being sandwiched between said guide bar and said rotatable disc so as to be fixedly clamped in place when said clamping member is tightened.

2. The arrangement of claim 1, said guide slot extending over a rotational angle lying in the range of 360° to 450°.

3. The arrangement of claim 1, said guide slot being formed in said disc so as to extend arcuately about said center so as to be at minimum and maximum distances from said center; and, the difference between said minimum and maximum distances being approximately 20 mm.

4. The arrangement of claim 1, said rotatable disc having an outer periphery and a plurality of indentations formed in said periphery.

5. The arrangement of claim 1, further comprising a guide lug formed on said housing and engaging said elongated opening for guiding said guide bar.

6. The arrangement of claim 1, said slide piece being a U-shaped slide piece having two legs and a bight segment interconnecting said legs; said legs having respective outer ends; said U-shaped slide piece having a first side facing said guide bar and a second side facing said rotatable disc; said engaging means of said slide piece including first and second projections disposed on said legs near the outer ends thereof, respectively, so as to project outwardly from said first side; said guide bar having two openings formed therein for receiving said projections, respectively; and, said lug being provided on said bight segment so as to extend outwardly from said second side into said guide slot.

7. The arrangement of claim 1, further comprising friction means interposed between said rotatable disc and said clamping device to provide a friction-tight interface when said clamping device is tightened.

8. The arrangement of claim 1, said stud bolt being fixedly attached to said housing so as to extend through said guide bar, said slide piece, and said rotatable disc; and, said clamping member being a wing nut threadably engaging said stud bolt.

9. The arrangement of claim 1, said stud bolt being fixedly attached to said housing so as to extend through said guide bar, said slide piece, and said rotatable disc; and, said clamping member being a handwheel threadably engaging said stud bolt and having peripheral undulations formed thereon.

10. The arrangement of claim 1, further comprising a pressure plate secured against rotation and interposed between said rotatable disc and said clamping member to provide a friction-tight interface when said clamping member is tightened.

11. The arrangement of claim 10, said pressure plate being a sprocket wheel cover of said motor-driven chain saw.

12. An arrangement for tensioning the saw chain of a motor-driven chain saw having a motor housing and a guide bar for guiding the saw chain, the guide bar defining a longitudinal axis and having two flat sides, one of the flat sides facing toward the housing and the other one of the flat sides facing away from the housing, the arrangement comprising:

said guide bar having an elongated opening formed therein so as to extend in the direction of said axis;

a stud bolt fixedly attached to said housing and extending transversely to said guide bar and through said elongated opening;

a clamping member mounted on said stud bolt which can be tightened to clamp the guide bar on said housing and which can be released to permit the guide bar to be moved along said axis;

a slide piece having engaging means for engaging said guide bar and a lug projecting from said slide piece in a direction transverse to said longitudinal axis;

a rotatable disc rotatably mounted on said stud bolt and having an approximately spiral guide slot formed therein for receiving said lug so that a rotational movement of said rotatable disc is translated via said slide piece into a linear movement of said guide bar thereby adjusting the tension in said saw chain;

said spiral guide slot defining a bearing cam surface for coacting with said lug to produce a frictional force which acts to resist rotation of said disc on said stud bolt;

said spiral slot being formed in said disc so as to extend spirally over a rotational angle of at least 270°;

said slide piece being a planar plate having a first side facing said guide bar and a second side facing said rotatable disc, said engaging means including a projection extending outwardly from said first side of said planar plate for engaging said elongated opening of said guide bar; said lug being provided on said second side of said planar plate so as to extend outwardly therefrom into said guide slot; and, said projection and said lug being disposed approximately along a common line perpendicular to said planar plate; and, said slide piece being sandwiched between said guide bar and said rotatable disc so as to be fixedly clamped in place at said first and second sides when said clamping member is tightened.

13. An arrangement for tensioning the saw chain of a motor-driven chain saw having a motor housing and a guide bar for guiding the saw chain, the guide bar defining a longitudinal axis and having two flat sides, one of the flat sides facing toward the housing and the other one of the flat sides facing away from the housing, the arrangement comprising:

said guide bar having an elongated opening formed therein so as to extend in the direction of said axis;

a stud bolt fixedly attached to said housing and extending transversely to said guide bar and through said elongated opening;

a clamping member mounted on said stud bolt which can be tightened to clamp the guide bar on said housing and which can be released to permit the guide bar to be moved along said axis;

a flat slide piece having engaging means for engaging said guide bar and having a lug projecting from said slide piece in a direction transverse to said longitudinal axis;

a rotatable disc rotatably mounted on said stud bolt and having an approximately spiral guide slot formed therein for receiving said lug so that a rotational movement of said rotatable disc is translated via said slide piece into a linear movement of said guide bar thereby adjusting the tension in said saw chain;

said spiral guide slot defining a bearing cam surface for coacting with said lug to produce a frictional force which acts to resist rotation of said disc on said stud bolt;

said spiral slot being formed in said disc so as to extend spirally over a rotational angle of at least 270°;

said flat slide piece being sandwiched between said guide bar and said rotatable disc so as to be fixedly clamped in place when said clamping member is tightened;

said bearing cam surface being a smooth uninterrupted continuous bearing cam surface; and, said spiral guide slot being formed in said disc so as to cause a tangent to said bearing cam surface at the point of contact of said lug therewith to be approximately orthogonal to said longitudinal axis irrespective of the angular position of said disc on said stud bolt.

14. An arrangement for manually tensioning the saw chain of a motor-driven chain saw without tools, the chain saw having a motor housing and a guide bar for guiding the saw chain, the guide bar being subjected to thrust forces during operation of the chain saw and defining a longitudinal axis; the guide bar having two flat sides, one of the flat sides facing toward the housing and the other one of the flat sides facing away from the housing, the arrangement comprising:

said guide bar having an elongated opening formed therein so as to extend in the direction of said axis;

a stud bolt fixedly attached to said housing and extending transversely to said guide bar and through said elongated opening;

a manually actuated clamping member mounted on said stud bolt which can be tightened by an operator of the chain saw by manually grasping said clamping member with the hand to provide a clamping force to clamp the guide bar on said housing to resist said thrust forces and which can be released to permit the guide bar to be moved along said axis;

a flat slide piece having a flat body and having engaging means formed on said flat body for engaging said guide bar and having a lug projecting from said flat body in a direction transverse to said longitudinal axis;

a manually actuated rotatable disc rotatably mounted on said stud bolt with only sufficient play to allow said disc to be manually rotated by the operator by grasping said disc with the hand;

said rotatable disc having an approximately spiral guide slot formed therein for receiving said lug so that a rotational movement of said rotatable disc is translated via said slide piece into a linear movement of said guide bar thereby adjusting the tension in said saw chain;

said spiral guide slot defining a bearing cam surface for coacting with said lug to produce a frictional force which acts to resist rotation of said disc on said stud bolt;

said spiral slot being formed in said disc so as to extend spirally over a rotational angle of at least 270°;

said engaging means, said flat body, said lug, said bearing cam surface, and said rotatable disc conjointly defining a reaction force path between said guide bar and said stud bolt; and, said flat body being sandwiched between said guide bar and said rotatable disc so as to be fixedly clamped in place between said guide bar and said rotatable disc when said clamping member is tightened to transmit said clamping force to said guide bar and to augment said clamping force to resist said thrust forces via said reaction force path between said guide bar and said stud bolt.

15. The arrangement of claim 14, said guide slot extending over a rotational angle lying in the range of 360° to 450°.

16. The arrangement of claim 14, said guide slot being formed in said disc so as to extend arcuately about said center so as to be at minimum and maximum distances from said center; and, the difference between said minimum and maximum distances being approximately 20 mm.

17. The arrangement of claim 14, said rotatable disc having an outer periphery and a plurality of indentations formed in said periphery.

18. The arrangement of claim 14, further comprising a guide lug formed on said housing and engaging said elongated opening for guiding said guide bar.

19. The arrangement of claim 14, said flat body being a U-shaped slide piece having two legs and a bight segment interconnecting said legs; said legs having respective outer ends; said U-shaped flat body having a first side facing said guide bar and a second side facing said rotatable disc; said engaging means of said slide piece including first and second projections disposed on said legs near the outer ends thereof, respectively, so as to project outwardly from said first side; said guide bar having two openings formed therein for receiving said projections, respectively; and, said lug being provided on said bight segment so as to extend outwardly from said second side into said guide slot.

20. The arrangement of claim 14, said spiral guide slot being formed in said disc so as to cause a tangent to said bearing cam surface at the point of contact of said lug therewith to be approximately orthogonal to said longitudinal axis irrespective of the angular position of said disc on said stud bolt.

21. The arrangement of claim 14, said stud bolt being a single stud bolt.

* * * * *